US009485809B2

(12) United States Patent
Ritzhaupt et al.

(10) Patent No.: US 9,485,809 B2
(45) Date of Patent: Nov. 1, 2016

(54) HEATING ROD

(71) Applicant: BorgWarner BERU Systems GmbH, Ludwigsburg (DE)

(72) Inventors: Victor Ritzhaupt, Karlsruhe (DE); Alexander Dauth, Maulbronn (DE); Michael Luppold, Dettenheim (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 92 days.

(21) Appl. No.: 14/169,917

(22) Filed: Jan. 31, 2014

(65) Prior Publication Data

US 2014/0217089 A1 Aug. 7, 2014

(30) Foreign Application Priority Data

Feb. 4, 2013 (DE) ..... 10 2013 101 077
Oct. 25, 2013 (DE) ..... 10 2013 111 811

(51) Int. Cl.
*H05B 3/58* (2006.01)
*H05B 3/44* (2006.01)

(52) U.S. Cl.
CPC ..... *H05B 3/44* (2013.01); *H05B 2203/023* (2013.01)

(58) Field of Classification Search
CPC ..... H05B 3/44; H05B 3/46; H05B 3/48; H05B 3/50; H05B 1/0236; H05B 2203/023; D06F 58/26; D06F 58/28; D06F 2058/289
See application file for complete search history.

(56) References Cited

U.S. PATENT DOCUMENTS

| | | | | |
|---|---|---|---|---|
| 5,077,889 | A * | 1/1992 | Matsuda | H05B 3/50 228/180.1 |
| 5,889,260 | A | 3/1999 | Golan et al. | |
| 2011/0062145 | A1* | 3/2011 | Yang | D06F 58/26 219/538 |

FOREIGN PATENT DOCUMENTS

| | | | |
|---|---|---|---|
| CN | 1273017 | A | 11/2000 |
| CN | 2554888 | Y | 6/2003 |
| DE | 198 48 169 | A1 | 5/1999 |
| DE | 10 2009 013 927 | A1 | 6/2010 |
| EP | 2 199 704 | A2 | 6/2010 |
| JP | 08-08043 | | 1/1996 |
| JP | 2000-195649 | A | 7/2000 |

* cited by examiner

*Primary Examiner* — Shawntina Fuqua
(74) *Attorney, Agent, or Firm* — Bose McKinney & Evans LLP

(57) ABSTRACT

The invention relates to a heating rod, comprising a housing made of metal, a heating element disposed in the housing, and a contact plate, which is seated against the heating element with a front and which protrudes from the housing. It is provided according to this disclosure that the contact plate is an aluminum sheet having an anodized back and the contact plate comprises projections for positioning the heating element.

10 Claims, 2 Drawing Sheets

HEATING ROD

RELATED APPLICATIONS

This application claims priority to DE 10 2013 101 077.6, filed Feb. 4, 2013, and DE 10 2013 111 811.9, filed Oct. 25, 2013, both of which are hereby incorporated herein by reference in their entireties.

BACKGROUND

The invention relates to a heating rod such as is generally known from DE 198 48 169 A1, for example.

Heating rods are used for auxiliary heaters of automobiles. In such heating devices, sheet metal lamellae can be placed onto the heating rods as heat sinks. Heating rods can also be designed integrally with heat sinks, as is known from DE 10 2009 013 927 A1, for example.

In known heating rods, the heating elements are held in the housing by an electrically insulating frame and are electrically contacted by a contact plate protruding from the housing. The contact plate is electrically insulated with respect to the housing by an insulating plate.

SUMMARY

This disclosure teaches how a heating rod can be produced with lower complexity and how better heat coupling of the heating element or of the heating elements to the housing can be achieved.

According to this disclosure, electrical insulation of the contact plate is achieved by using an aluminum sheet that is anodized on one side as the contact plate, instead of using a separate insulating plate. The aluminum sheet is covered with an electrically insulating anodic coating on one of the two sides thereof and contacts the heating element or the heating elements of the heating rod on the other side. During anodization of aluminum, the surface is converted into an oxide layer and in this way an electrical insulating layer is generated. The anodization of aluminum sheets is also called electrolytic oxidation, anodic oxidation or anodic treatment.

This disclosure enables more cost-effective manufacturing. Moreover, the heating rod can be made thinner and have improved heat coupling of the heating element or of the heating elements to the housing.

The front of the contact plate may be covered by a protective coating during anodization, such as wax, paint or a plastic film. The protective coating is removed after anodization. Thus the front of the contact plate has a metallic surface, which can electrically contact a heating element.

In principle, the higher the operating voltage of the heating rod, the greater must be the thickness of the anodic coating. At operating voltages of 12 volts, as provided by the onboard power system of a motor vehicle, an anodic coating having a thickness of at least 10 μm may be sufficient. The anodic coating is preferably at least 20 μm thick.

In a heating rod according to this disclosure, the contact plate can have projections for positioning the heating element. In this way a plastic frame, which in known heating rods holds the heating elements, can be dispensed with and a heating rod can be produced from an advantageously small number of different components.

The projections for positioning the heating element or the heating elements can be created, for example, in the contact plate by way of embossing, for example in the form of protuberances. Another option is to cut tabs out of the contact plate and set these up by bending them. The projections can also be formed by bending opposing edge sections of the contact plate, for example the longitudinal edges.

According to an advantageous refinement of this disclosure, the anodized back of the contact plate is dyed. In this way, an incorrect orientation of the contact plate during assembly of a heating rod can be easily detected and thus prevented. Oxide layers on aluminum are frequently transparent and difficult to detect by the naked eye. As a result of a dyed back, it can be easily detected by the naked eye which of the two sides of the contact plate carries the electrically insulating anodic coating and which is provided as the contact side.

The dyed back of the contact plate can be generated by an additional coating, such as a colored paint. Preferably, however, the anodic coating itself is dyed. Anodic coatings can be dyed electrolytically with metal salt solutions. Such dyeing can be carried out during or subsequent to the anodization.

BRIEF DESCRIPTION OF THE DRAWINGS

Further details and advantages of this disclosure are explained using embodiments, with reference to the attached drawings. Components that are identical and correspond to one another are labelled therein using matching reference numerals. In the drawings.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
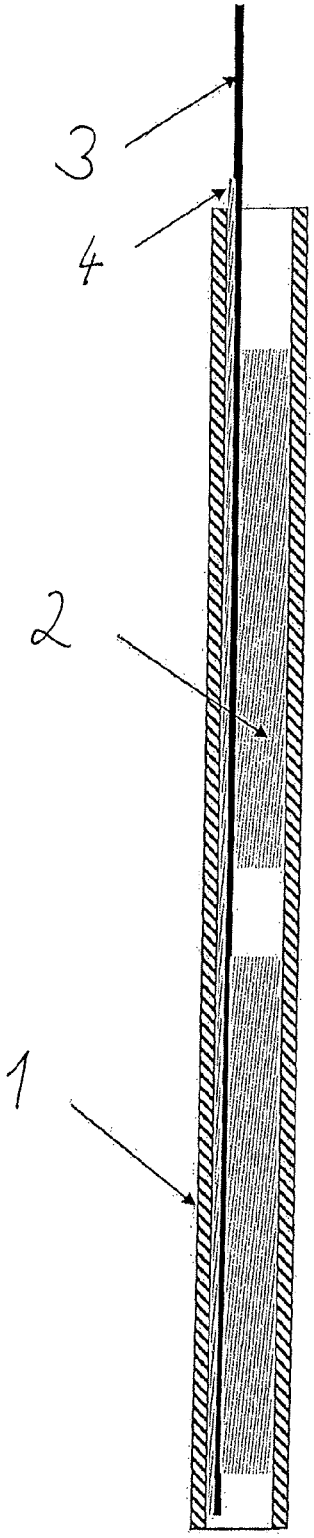
FIG. 1 shows a schematic longitudinal section of a heating rod.

The heating rod shown schematically in a sectional view in FIG. 1 comprises a housing 1 made of metal. The housing 1 is preferably a tube, such as a rectangular tube. One or more ceramic heating elements 2 are disposed in the housing 1. The heating elements 2 may be PTC heating elements. The heating elements 2 are seated against the front of a contact plate 3 protruding from the housing 1. The contact plate 3 has an anodized back. The anodic coating 4 on the back provides an electrical insulation of the contact plate 3 with respect to the housing 1.

The heating elements 2 are electrically contacted by the housing 1 on the sides thereof facing away from the contact plate 3. During operation, a heating current thus flows through the contact plate 3, the heating elements 2 and the housing 1. The contact plate 3 is an aluminum sheet, for example made of technically pure aluminum or an aluminum base alloy, such as AlMg3. The housing 1 can likewise be produced from aluminum.

The heating elements 2 and the contact plate 3 can be held in the housing 1 by a mounting frame, which is not shown in FIG. 1 for the sake of simplicity. After the contact plate 3 and the heating elements 2 have been introduced, the housing 1 can be compressed so as to improve the heat coupling of the heating elements 2 to the housing 1.

The anodic coating 4 can have a thickness of more than 20 μm, for example 30 μm or more. The anodic coating 4 can be dyed, so that it is immediately apparent during installation of the heating rod which side of the contact plate 3 is the contact side thereof and which is the insulated back thereof.

Figure 2:
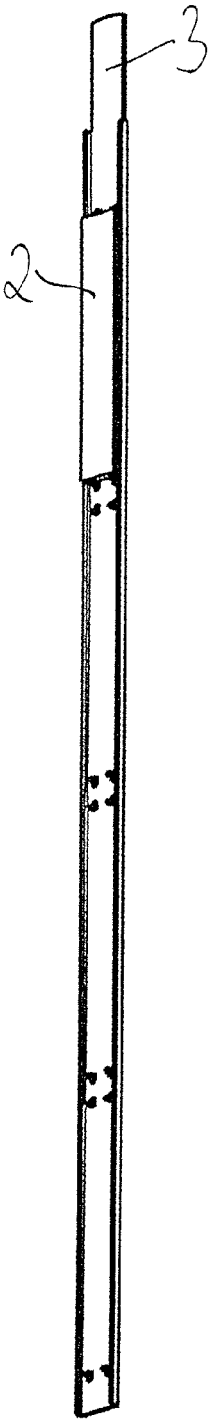
FIG. 2 shows an isometric view of a contact plate comprising a heating element.
Figure 3:
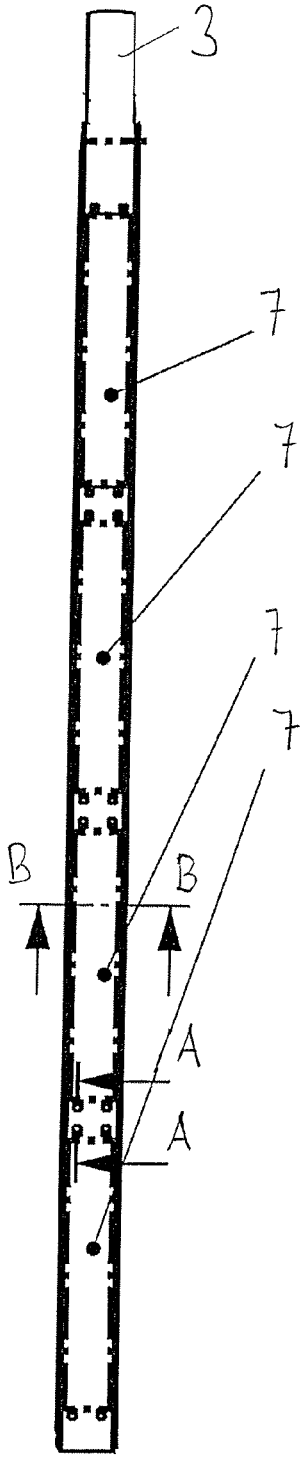
FIG. 3 shows a top view of the contact plate.
Figure 4:
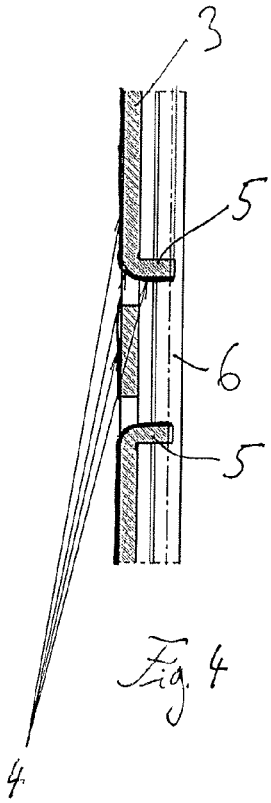
FIG. 4 shows a sectional view along the intersecting line AA of FIG. 3.

The contact plate 3 shown in FIGS. 2 to 4 has an anodic coating 4 on the back thereof and projections 5, 6 for positioning the heating elements 2 on the front thereof. These projections 5, 6 define partitions 7 in which the heating elements 2 are seated.

Figure 5:
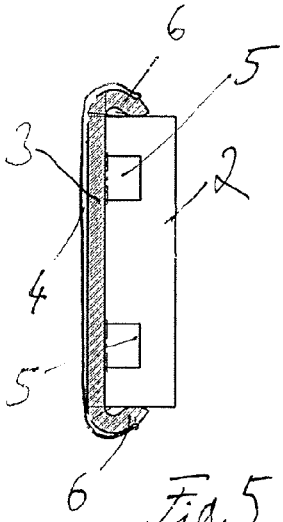
FIG. 5 shows a sectional view along the intersecting line BB of FIG. 3.

Some of these projections can be lugs, which are cut out of the contact plate 3 and set up. For example, a U-shaped cut can be made into the contact plate 3, and the lug delimited by the U-shaped cutting line can be raised by bending. Such projections are denoted by reference numeral 5 in FIGS. 5 and 6.

In addition, projections for positioning the heating elements 2 can also be formed by bent edge sections of the contact plate 3. These projections are denoted by reference numeral 6 in FIGS. 5 and 6. The heating elements 2 can be held in a clamping manner between the bent sections at the longitudinal edge of the contact plate 3. It is advantageous for this purpose if the edge sections 6 are bent in an S-shaped manner, so that the edge sections are seated with a bend against the heating elements 2 and the longitudinal edge of the contact plate 3 faces away from the heating elements 2. In this way the risk of damaging the heating elements 2 as a result of clamping forces from the contact plate 3 can be reduced.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heating rod, comprising:

a housing made of metal;

a ceramic heating element disposed in the housing; and a contact plate, the front of which is seated against and electrically contacts the heating element, the contact plate protruding from the housing;

wherein the contact plate is an aluminum sheet having an anodized back.

2. The heating rod according to claim 1, wherein the anodized back carries an anodic coating that is at least 10 μm thick.

3. A heating rod according to claim 1, wherein the anodized back is dyed.

4. A heating rod according to claim 1, wherein the contact plate comprises projections for positioning the heating element.

5. The heating rod according to claim 4, wherein at least some of the projections are lugs, which are cut out of the contact plate and bent upward.

6. The heating rod according to claim 5, wherein the projections or some of the projections are bent edge sections of the contact plate.

7. The heating rod according to claim 6, wherein the heating element is held in a clamping manner by the bent edge sections of the contact plate.

8. The heating rod according to claim 6, wherein the edge sections are bent in an S-shape, the edge sections facing the heating element with a bend and the sheet edge of the edge sections facing away from the heating element.

9. A heating rod according to claim 1, wherein the heating element, on the side thereof facing away from the contact plate, is electrically contacted by the housing.

10. A heating rod according to claim 1, wherein the housing is a tube.

* * * * *